United States Patent [19]

Turner

[11] Patent Number: 4,708,774

[45] Date of Patent: Nov. 24, 1987

[54] COAL COMPACTOR ROD RETAINER

[75] Inventor: Gerhard Turner, Überherrn, Fed. Rep. of Germany

[73] Assignee: Saarbergwerke AG, Saarbrucken, Fed. Rep. of Germany

[21] Appl. No.: 897,060

[22] PCT Filed: Dec. 6, 1985

[86] PCT No.: PCT/DE85/00510

§ 371 Date: Aug. 4, 1986

§ 102(e) Date: Aug. 4, 1986

[87] PCT Pub. No.: WO86/03509

PCT Pub. Date: Jun. 19, 1986

[30] Foreign Application Priority Data

Dec. 11, 1984 [DE] Fed. Rep. of Germany ..... 3445068

[51] Int. Cl.[4] ..... C10B 45/02; B30B 11/00

[52] U.S. Cl. ..... 202/239; 173/53; 425/431

[58] Field of Search ..... 202/239, 270; 201/6; 44/106, 11, 13; 100/209, 218, 219; 173/53; 425/431, 469, 451.7

[56] References Cited

U.S. PATENT DOCUMENTS

| | | | |
|---|---|---|---|
| 4,111,664 | 9/1978 | Leibrock | 44/10 G |
| 4,123,216 | 10/1978 | Leibrock | 425/431 |
| 4,128,402 | 12/1978 | Leibrock et al. | 44/11 |
| 4,533,002 | 8/1985 | Leibrock et al. | 173/53 |

*Primary Examiner*—Barry S. Richman
*Assistant Examiner*—Joye L. Woodard
*Attorney, Agent, or Firm*—Karl F. Ross; Herbert Dubno; Ronald Lianides

[57] ABSTRACT

Compacting rod retainers are disposed on both sides of a web of the compacting rods and consist each of a bushing mounted on a drive shaft eccentrically, on which a carrier is slidably engaged, and cooperating with an associated clamping wedge. The opposite side of the clamping wedge cooperates correspondingly with the web of the compacting rod, so that upon an appropriate rotary motion of the shaft the carrier is moved translating the clamping wedge pressing against the web of the compacting rod, or releasing it. Thereby area pressure is attained, which makes possible the utilization of very heavy compacting rods.

7 Claims, 2 Drawing Figures

COAL COMPACTOR ROD RETAINER

FIELD OF THE INVENTION

This invention concerns a coke compactor for the production of a compressed cake of coal intended for coking, with rod retainers associated with the individual compacting rods, which retain the several rods after the compacting procedures and during the charging procedure at the upper limit of travel by means of a clamping element.

BACKGROUND OF THE INVENTION

To achieve a sufficient quality of coke, the coking coals are compacted by means of free-falling compacting rods in a form provided therefor, and then placed into the coke ovens in the shape of a compacted cake of coal. During the charging of the coke oven the compacting rods must be retained in their upper limits of travel so that the compacted cake of coal can be removed from the form. Until now, the retention of the raised stamping rods was accomplished by eccentrically journaled segment disks which are arrayed rotatably about a horizontal axle and lie against the compacting rods due to their own weight. By appropriate counter-rotation of the shafts carrying the segment disks, the compacting rods are then released again, in order to be raised rhytmically and released for free fall by means of known devices. In the known compacting rod retainers, the transfer of the pressure force is effected by the line contact between the compacting rod which is usually equipped with a friction lining and the segment disks. The transferrable pressure force is thus limited, so that for ovens higher than 6 m, and the longer compacting rods necessitated thereby, the likewise higher weight of the compacting rods cannot be retained securely by the pressure force of the segment disks.

OBJECT OF THE INVENTION

It is an object of the invention to provide a compacting rod retainer which makes a reliable operation possible with the heavier compacting rods provided for taller ovens.

SUMMARY OF THE INVENTION

In the present invention, the object is achieved in that the clamping element is formed as a bushing surrounding the shaft eccentrically, to which a carrier is slidably engaged with an associated clamping wedge provided thereon and cooperating with a web of the compacting rod, the clamping wedge being secured against unwanted clamping.

By means of the implementation of the compacting rod retainer according to the invention, it is possible to exert high pressure forces upon the web of the compacting rod via the carrier and clamping wedge even with small rotational motions of the shaft. Thereby it is to be emphasized, and is advantageous, that the transfer of forces is effected by area pressure, so that the compacting rod retainers, with less wear, will fix significantly heavier compacting rods in their upper end position when the coal cake is placed into the coke oven. The carrier engages the bushing and is fixed against rotation, and as already mentined above, can be shifted by means of very small rotations of the shaft so that the clamping element engaging the web of the compacting rod can be immobilized, or retracted whereby the compacting rod can again be released for free fall.

In order to assure an effective wedge seat, it is provided according to the invention that the carrier is arranged so as to form an upwardly open angle with the web of the compacting rod. Thus the clamping wedge during the several motions to be effected by it always drops automatically into the wedge seat, so that an always constant and high transfer of forces upon the web of the compacting rod is assured. The removal of the compacting rod can be effected without separate loosening, that is without a separate control of the lifting device. Thus the entire lifting device construction is much simpler. Suitably, the effectiveness of the compacting rod retainers is further increased in that the inclined surfaces at the cooperating sides of the carrier and clamping wedge are formed so as to secure a self-locking action. By suitable correct selection of the wedge angle or the inclined surfaces, the advantageous self-locking of the system is assured.

In order to attain a reliable fixation of the compacting rods in any upper end position, it is provided according to the invention that with each compacting rod, facing one another, two such clamping wedges and carriers with the bushings connected to the shaft, and with the wedges and carriers secured against rotation are provided. It is already known in principle to arrange the segment disks opposite one another, but this is done due to sheer necessity and without essentially improving the system. In the present case, however, the realization of the object, according to which two such clamping wedges and carriers with the bushing connected to the shaft, and with the wedges and carriers secured against rotation being provided with each compacting rod, causes a distinct improvement, since the system would also function if the clamping wedges and carriers were provided on one side only, and on the other side simply a support surface.

A further suitable embodiment provides that the brake plate of the clamping wedge placeable against the web of the compacting rod is formed so that it can be lengthened in the longitudinal axis of the web. Thus the area transferring force can be increased or decreased, depending on requirements. For increasing the clamping forces it will also be advantageous to provide, in addition to the friction surface on the web, plate a friction surface on the brake plate. In this simple manner, the holding force can be effectively increased.

In one embodiment of the invention, a uniform operation of the compacting rod retainer is assured in that guides arrayed lengthwise are associated with the carrier. Thus transverse displacement of the several elements of the compacting rod retainer is effectively prevented.

Therefor, a groove is suitably formed in the end faces, in which the gibs associated with the clamping wedge are engaged. A uniform displacement of the carrier and the clamping wedge is thus assured, even when after long operation dirt has adhered, or the surfaces formed by the friction lining exhibit unevenness.

In such implementation of the guiding groove, the securing of the clamping wedge in the open position of the compacting rod retainer is suitably accomplished in such manner that a key securing the clamping wedge in the open position is associated with the lower end of the groove. The clamping wedge is thus secured against unwanted clamping in the open position, since it is prevented simply and securely from sliding further down by the key.

The invention is particularly distinguished by the fact that a positive system of compacting rod retention is created, which operates reliably, indpendent of the weight of the individual compacting rod, and which remains fully effective after long periods of operation or appearance of wear. This advantageous retention of compacting rods attains its high reliability particularly due to the fact that the force transfer between the retainer and the web of the rods occurs due to area pressure. The dimensions of the areas available for area pressure can be selected in accordance with actual operating conditions, and can also be implemented adaptably.

BRIEF DESCRIPTION OF THE DRAWING

Further details and advantages of the invention will become more evident from the following description of the associated drawing, in which.

SPECIFIC DESCRIPTION

Figure 1:
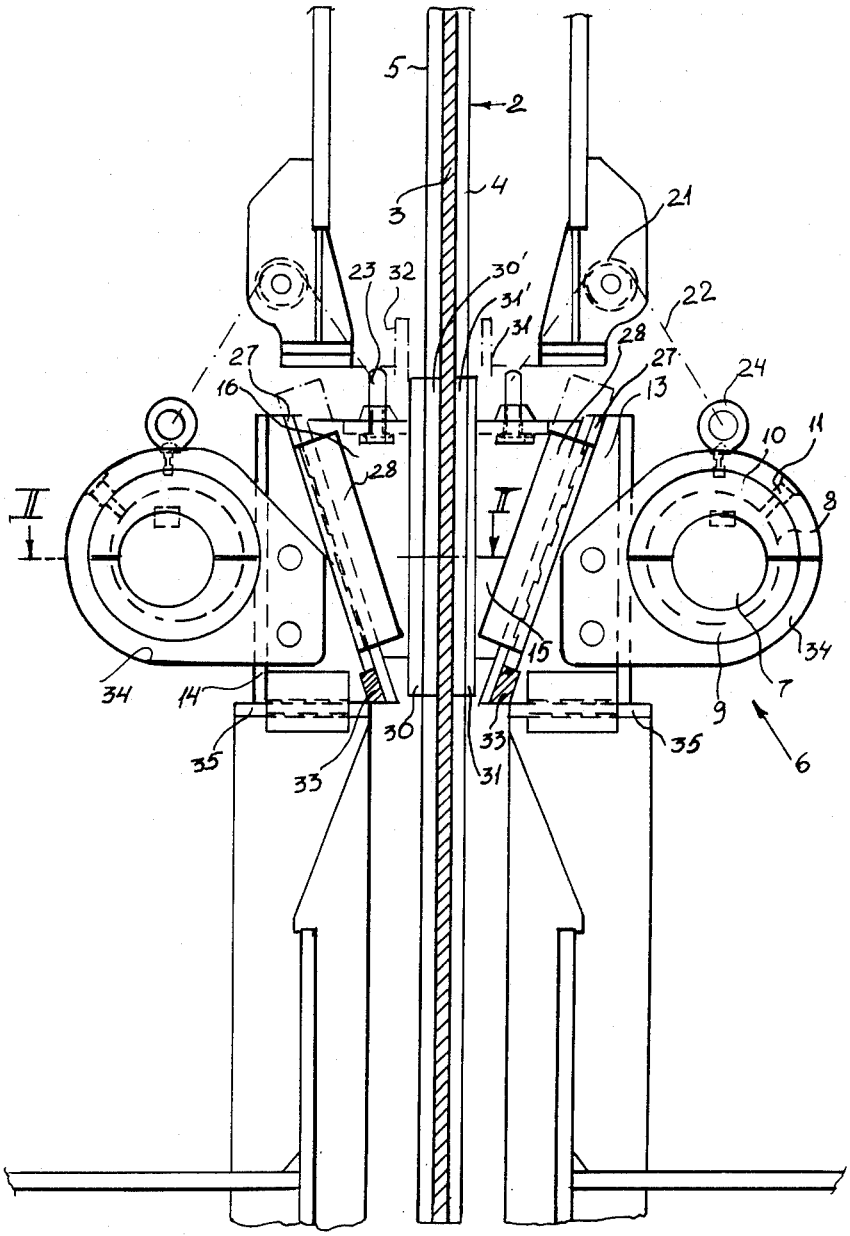
FIG. 1 is a side elevational view of a compacting rod flanked by two compacting rod retainers and FIG. 2 is a partial cross section taken along line II—II of FIG. 1.
Figure 2:
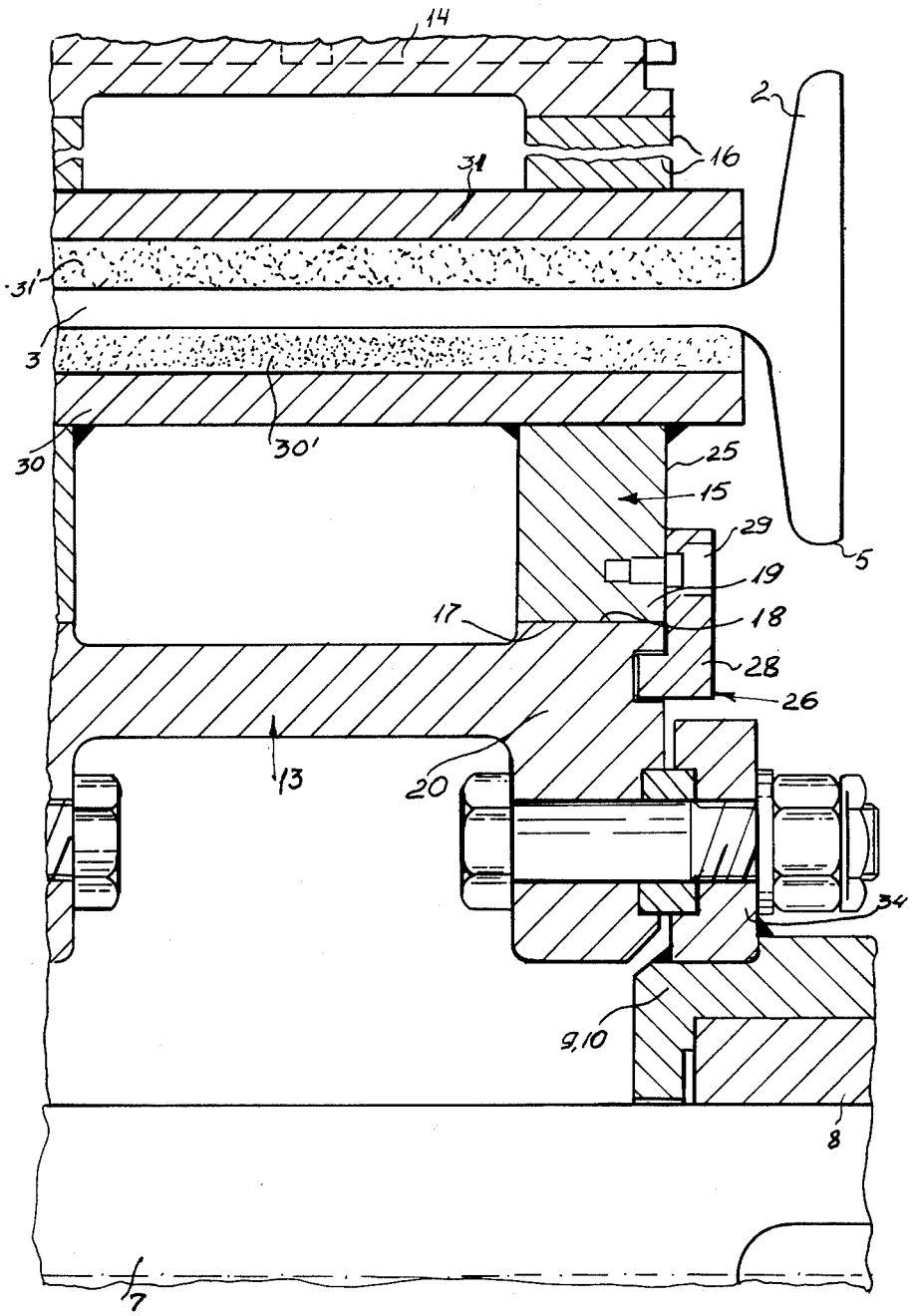

The compacting rod retainer 1 shown in FIGS. 1 and 2 is intended to fix and retain the compacting rod 2 in the form of an I-beam in its upper end position, while the coal cake is removed from its form and placed into the coke oven. Thereby the compacting rod retainers 1 act areawise upon the web 3 of the compacting rod 2 where depending on circumstances either a portion or the entire web between the two flanges 4, 5 of the compacting rod is acted upon.

At least a pair of compacting rod retainers 1, 6 are each provided with a driven shaft 7, upon which an eccentric bushing 8 is clamped for rotation therewith. The bushing 8 is formed as a single piece and covered on each half by cover halves 9, 10, so that an axial displacement of the bushing can not occur. The cover halves 9, 10 are mounted on plates 34 which are connected via fastening screws to carriers 13 and 14. A lubricating connection or grease nipple is designated by 11.

The carriers 13, 14 are slidably connected to bushing 8. These carriers are formed wedge-shaped and can be displaced sideways along tracks 35 by means of the eccentricity of bushing 8 imparting a shuttling action to the carriers by appropriate rotation of shaft 7. Thereby they affect the clamping wedge 15, 16 located in the wedge seat formed between sliders 13, 14 and the web 3.

The respective inclined surfaces 17, 18 of the clamping wedges 15, 16 and the carriers 13, 14 cooperate with one another so that the entire arrangement operates in a self-locking manner. The side portions 19, 20 of the cooperating sliders 13, 14 and clamping wedges 15, 16 are formed accordingly as inclined planes, as shown in FIGS. 1 and 2.

Guides 26 are formed on the side faces 25 of the carriers 13, 14 and the clamping wedges 15, 16. Thereby a uniform sliding of the two elements on one another is assured, whereby guide 26 is suitably formed by a groove 27 formed in carriers 13, 14 engaged by a gib 28 associated with clamping wedge 15, 16. This gib is detachably connected to clamping wedge 15 or 16 via holding screws 29, so that the assembly of the entire compactor retainer system is facilitated.

An undesired clamping of the clamping wedge 15, 16 is prevented by the fact that the grooves 27 are provided with a key 33 which prevents too far a shifting of the clamping wedge simply and reliably. In place of the key 33 it is also possible to provide alternately an end stop which locks the clamping wedge, or to stop the clamping wedge in a different manner in a predetermined position. Therefor FIG. 1 provides, in addition to the implementation of the key, that alternately, eyebolts 23 are associated with the clamping wedges, on which the cable 22 passing over return roller 21 is held and secured. On the other side, the cable is fastened to eye bolt 24 on the housing, so that too far a drop of the clamping wedge 15, 16 beyond the position predetermined by the length of cable 22 is prevented as shown in dot-dash lines.

The area with which the clamping wedges 15, 16 act upon web 3 of the compacting rod 2 is predetermined by brake plates 30, 31. These plates 30, 31 are connected to the other portions of the clamping wedge 15, 16, as is indicated in FIG. 2, by welding beads. However, it is also possible to fasten these plates 30, 31 detachably on clamping wedges 15, 16, so that, if required by a need for greater area pressure, they can be exchanged and replaced by larger ones.

For increasing the holding ability of the brake plates 30 and 31, friction surfaces in the form of respective brake shoes 30' and 31' can be provided.

I claim:

1. A compacting rod retainer for a coal compactor, comprising:

an upright compacting rod in the form of an I-beam;

a pair of compacting rod retainers disposed on opposite sides of said rod, and each said retainer comprising:

a rotatable drive shaft, a bushing eccentrically mounted on said shaft for rotation therewith, a linearly reciprocatable carrier engaging said bushing in a non-rotatable manner and extending transversely thereof, and a.clamping wedge slidably mounted on said carrier and juxtaposed with a web of said rod, whereby upon rotation of said shaft and the associated bushing, said carrier is displaced towards said compacting rod to engage said web with said wedge or to release said web from engagement with said wedge.

2. The retainer defined in claim 1 wherein said wedge is mounted on said carrier along a first surface formed on said wedge and a second surface formed on said carrier, said first and second surfaces being inclined to said web at an upwardly open angle, whereby the engagement of said web by said wedge is self-locking.

3. The retainer defined in claim 1 wherein said wedge is provided with a brake plate engageable with said web, said brake plate being extendable in a longitudinal direction of said rod.

4. The retainer defined in claim 3 wherein said brake plate is provided with a friction surface engageable with said web.

5. The retainer defined in claim 2 wherein a guide is provided adjacent the mounting surfaces of said wedge and said carrier for slidably holding said wedge on said carrier.

6. The retainer defined in claim 5 wherein said guide comprises a groove formed in each sideface of said carrier adjacent the second surface and inclined at said upwardly open angle and at least one gib mounted on each sideface of said wedge adjacent the first surface and slidably engaging the respective groove on said carrier.

7. The retainer defined in claim 6 wherein a key is provided in a lower end of at least one of said grooves and engageable by the respective gib thereof for preventing said gib from sliding out of said groove in an unengaged position of said wedge and said web.

* * * * *